US008341983B2

(12) United States Patent
Chang

(10) Patent No.: US 8,341,983 B2
(45) Date of Patent: Jan. 1, 2013

(54) DRUM-TYPE WASHING MACHINE

(75) Inventor: Jae-Won Chang, Gunpo (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 13/239,416

(22) Filed: Sep. 22, 2011

(65) Prior Publication Data

US 2012/0011895 A1 Jan. 19, 2012

Related U.S. Application Data

(63) Continuation of application No. 12/985,389, filed on Jan. 6, 2011, which is a continuation of application No. 12/639,872, filed on Dec. 16, 2009, now Pat. No. 7,930,910, which is a continuation of application No. 12/267,457, filed on Nov. 7, 2008, which is a continuation of application No. 10/461,451, filed on Jun. 16, 2003, now Pat. No. 7,533,548.

(30) Foreign Application Priority Data

Dec. 27, 2002 (KR) ..... 2002-85521

(51) Int. Cl.
*D06F 37/20* (2006.01)

(52) U.S. Cl. ..... 68/25; 68/58; 68/140

(58) Field of Classification Search ..... 68/24, 58, 68/140

See application file for complete search history.

(56) References Cited

U.S. PATENT DOCUMENTS 912,038 A 2/1909 Seifert
1,077,043 A 10/1913 Darrow
1,470,245 A 10/1923 Slider
1,611,865 A 12/1926 Ahlm
1,611,895 A 12/1926 Dienner
1,657,181 A 1/1928 Sando
1,787,427 A 1/1931 Eckhard ..... 68/140
2,089,066 A 8/1937 Morrill ..... 248/26
2,096,649 A 10/1937 Rasanen
2,152,458 A 3/1939 Bergman ..... 172/36
2,153,418 A 4/1939 Haberstump ..... 286/5
2,165,884 A 7/1939 Chamberlin et al. ..... 8/159
2,191,607 A 2/1940 Chamberlin et al. ..... 237/20

(Continued)

FOREIGN PATENT DOCUMENTS

CN 2423308 Y 3/2001

(Continued)

OTHER PUBLICATIONS

U.S. Office Action dated Dec. 30, 2005 issued in U.S. Appl. No. 10/461,451.

(Continued)

*Primary Examiner* — Frankie L Stinson
(74) *Attorney, Agent, or Firm* — KED & Associates, LLP

(57) ABSTRACT

A drum type washing machine is provided. The drum type washing machine may include a cabinet, a tub fixed to an inner side of the cabinet, a drum rotatably arranged in the tub, and a driving motor positioned at a rear side of the drum for generating a driving force that rotates the drum. The washing machine may also include a supporting plate to rotatably support a rotational shaft extending between the motor and the drum, and a plurality of supporters connected between the supporting plate and the cabinet. Such an arrangement may increase washing capacity by increasing a diameter of the drum without increasing an external size of the cabinet.

12 Claims, 9 Drawing Sheets

U.S. PATENT DOCUMENTS

| | | | | |
|---|---|---|---|---|
| 2,217,351 | A | 10/1940 | Soderquist | |
| 2,230,345 | A | 2/1941 | Bradbury | |
| 2,278,911 | A | 4/1942 | Breckenridge | |
| 2,296,257 | A | 9/1942 | Breckenridge | 68/24 |
| 2,296,261 | A | 9/1942 | Breckenridge et al. | 68/24 |
| 2,296,267 | A | 9/1942 | Baird | 68/23 |
| 2,323,765 | A | 7/1943 | Haberstump | 68/13 |
| 2,331,897 | A | 10/1943 | Dyer | |
| 2,356,816 | A | 8/1944 | Breckenridge et al. | 68/12 |
| 2,356,818 | A | 8/1944 | Bruckman | 68/24 |
| 2,389,774 | A | 11/1945 | Haberstump | 220/10 |
| 2,408,509 | A | 10/1946 | Clark | 68/23 |
| 2,434,476 | A | 1/1948 | Wales | 68/19 |
| 2,498,181 | A | 2/1950 | Reiter | 259/81 |
| 2,509,516 | A | 5/1950 | Murphy | 29/215 |
| 2,510,836 | A | 6/1950 | Russell et al. | 68/24 |
| 2,521,578 | A | 9/1950 | Haberstump | 68/19 |
| 2,526,002 | A | 10/1950 | Brotman | 68/140 |
| 2,526,048 | A | 10/1950 | Russell | 68/24 |
| 2,526,444 | A | 10/1950 | Woodson | |
| 2,527,239 | A | 10/1950 | Woodson | 68/23 |
| 2,541,166 | A | 2/1951 | Leef | 68/140 |
| 2,542,509 | A | 2/1951 | Goriup | 68/153 |
| 2,555,269 | A | 5/1951 | Chamberlin | |
| 2,556,490 | A | 6/1951 | Chamberlin | 8/159 |
| 2,565,604 | A | 8/1951 | Geiger | 68/140 |
| 2,579,472 | A | 12/1951 | Chamberlin et al. | 68/24 |
| 2,579,836 | A | 12/1951 | Lee et al. | 260/26 |
| 2,589,284 | A | 3/1952 | O'Neil | 34/77 |
| 2,593,752 | A | 4/1952 | Haberstump | 68/61 |
| 2,615,320 | A | 10/1952 | Belaieff | 68/24 |
| 2,620,070 | A | 12/1952 | Dodge | 210/365 |
| 2,629,245 | A | 2/1953 | Chamberlin | |
| 2,644,326 | A | 7/1953 | Worst | 68/23 |
| 2,652,708 | A | 9/1953 | Rimsha et al. | |
| 2,656,700 | A | 10/1953 | Smith | 68/23 |
| 2,664,326 | A | 12/1953 | Kuzmick | |
| 2,711,297 | A | 6/1955 | Thiele | 248/18 |
| 2,717,135 | A | 9/1955 | Douglas | 248/20 |
| 2,737,799 | A | 3/1956 | Knipmeyer | |
| 2,757,531 | A | 8/1956 | Fox | |
| 2,758,685 | A | 8/1956 | Sisson | 192/3.5 |
| 2,774,621 | A | 12/1956 | Kilbourne, Jr. | 228/23 |
| 2,785,557 | A | 3/1957 | Stilwell, Jr. | 68/12 |
| 2,836,046 | A | 5/1958 | Smith | 68/24 |
| 2,843,314 | A | 7/1958 | Hansen | 230/232 |
| 2,844,225 | A | 7/1958 | Hubbard et al. | |
| 2,844,255 | A | 7/1958 | Cavenah et al. | |
| 2,859,877 | A | 11/1958 | Sisson | |
| 2,873,599 | A | 2/1959 | Buechler | 68/24 |
| 2,882,706 | A | 4/1959 | Brucken | 68/23 |
| 2,893,135 | A | 7/1959 | Smith | |
| 2,895,319 | A | 7/1959 | Rochefort | 68/3 |
| 2,908,871 | A | 10/1959 | McKay | 331/108 |
| 2,930,217 | A | 3/1960 | Rehmke | 68/24 |
| 2,937,516 | A | 5/1960 | Czaika | |
| 2,957,330 | A | 10/1960 | Cline | |
| 2,959,966 | A | 11/1960 | Bochan | |
| 2,972,877 | A | 2/1961 | Platt | 68/18 |
| 2,975,528 | A | 3/1961 | Shewmon | |
| 2,984,094 | A | 5/1961 | Belaieff | 68/24 |
| 2,986,914 | A | 6/1961 | Brucken | 68/12 |
| 2,987,190 | A | 6/1961 | Bochan | |
| 2,990,706 | A | 7/1961 | Bochan | 68/12 |
| 2,995,023 | A | 8/1961 | Douglas | 68/131 |
| 2,995,918 | A | 8/1961 | Neidenthal et al. | |
| 2,987,189 | A | 9/1961 | Evjen | |
| 3,048,026 | A | 8/1962 | Bochan et al. | 68/12.09 |
| 3,058,331 | A | 10/1962 | Anthony | |
| 3,066,522 | A | 12/1962 | Steinmüller | 68/24 |
| 3,073,668 | A | 1/1963 | Rothenberger | |
| 3,089,326 | A | 5/1963 | Belaieff | 68/24 |
| 3,098,581 | A | 7/1963 | Marsilio | 220/46 |
| 3,135,688 | A | 6/1964 | Compans et al. | |
| 3,153,951 | A | 10/1964 | Whelan | 74/665 |
| 3,178,916 | A | 4/1965 | Belaieff et al. | 68/24 |
| 3,197,983 | A | 8/1965 | Ilmer | 68/24 |
| 3,206,267 | A | 9/1965 | Gruner et al. | 312/228 |
| 3,248,908 | A | 5/1966 | Pope | |
| 3,257,830 | A | 6/1966 | Shelton | 68/133 |
| 3,273,361 | A | 9/1966 | Smith | 68/12 |
| 3,280,603 | A | 10/1966 | Schwamm | |
| 3,333,444 | A | 8/1967 | Bochan | 68/208 |
| 3,356,222 | A | 12/1967 | Belaieff | 210/363 |
| 3,362,198 | A | 1/1968 | Barito | |
| 3,389,881 | A | 6/1968 | Stelwagen | 248/18 |
| 3,391,469 | A | 7/1968 | Reeder | 34/58 |
| 3,459,461 | A | 8/1969 | Bannon, Jr. | 213/214 |
| 3,477,259 | A | 11/1969 | Barnish et al. | 68/23.1 |
| 3,503,228 | A | 3/1970 | Lake | |
| 3,509,742 | A | 5/1970 | Bauer | 68/23.1 |
| 3,531,954 | A | 10/1970 | Krupsky | 68/18 |
| 3,742,738 | A | 7/1973 | Frotriede | |
| 3,783,653 | A | 1/1974 | Haerick | |
| 3,799,348 | A | 3/1974 | Mazza | |
| 3,927,542 | A | 12/1975 | de Hedouville et al. | 68/17 |
| 3,952,557 | A | 4/1976 | Bochan | |
| 4,114,406 | A | 9/1978 | Horowitz et al. | 68/24 |
| 4,295,387 | A | 10/1981 | Zhivotov et al. | 74/573 |
| 4,321,302 | A | 3/1982 | Umeki et al. | |
| 4,327,302 | A | 4/1982 | Hershberger | |
| 4,412,390 | A | 11/1983 | Grant | 34/58 |
| 4,437,325 | A | 3/1984 | Hershberger | |
| 4,446,706 | A | 5/1984 | Hartwig | 68/24 |
| 4,498,181 | A | 2/1985 | Menown et al. | 372/38 |
| 4,618,193 | A | 10/1986 | Cuthbert et al. | 312/264 |
| 4,771,253 | A | 9/1988 | Sasaki et al. | |
| 4,819,460 | A | 4/1989 | Obradovic | 68/23.7 |
| 4,989,684 | A | 2/1991 | Conaway | 180/89.15 |
| 5,038,586 | A | 8/1991 | Nukaga et al. | 68/12.01 |
| 5,080,204 | A | 1/1992 | Bauer et al. | 188/129 |
| 5,199,690 | A | 4/1993 | Marshall | 267/64.25 |
| 5,209,458 | A | 5/1993 | Eubank et al. | 254/88 |
| 5,230,229 | A | 7/1993 | Stadelmann et al. | 68/23.1 |
| 5,267,456 | A | 12/1993 | Nukaga et al. | 68/12.24 |
| 5,280,660 | A | 1/1994 | Pellerin et al. | 8/158 |
| 5,433,091 | A | 7/1995 | Durazzani et al. | |
| 5,526,657 | A | 6/1996 | Johnson | 68/3 |
| 5,548,979 | A | 8/1996 | Ryan et al. | |
| 5,570,597 | A | 11/1996 | Bongini et al. | |
| 5,657,649 | A | 8/1997 | Lim | 68/23.3 |
| 5,678,430 | A | 10/1997 | Merlin et al. | |
| 5,711,170 | A | 1/1998 | Johnson | 68/3 |
| 5,711,171 | A | 1/1998 | Uhlin | 68/4 |
| 5,737,944 | A | 4/1998 | Nishimura et al. | |
| 5,768,730 | A | 6/1998 | Matsumoto et al. | 8/159 |
| 5,842,358 | A | 12/1998 | Koo et al. | |
| 5,870,905 | A | 2/1999 | Imamura et al. | 68/12.04 |
| 5,907,880 | A | 6/1999 | Durazzani et al. | |
| 5,913,951 | A | 6/1999 | Herr et al. | 81/158 |
| 5,924,312 | A | 7/1999 | Vande Haar | |
| 5,961,105 | A | 10/1999 | Ehrnsberger et al. | 267/216 |
| 5,979,195 | A | 11/1999 | Bestell et al. | 68/23.2 |
| 6,006,553 | A | 12/1999 | Lee et al. | |
| 6,032,494 | A | 3/2000 | Tanigawa et al. | 68/12.06 |
| 6,122,843 | A | 9/2000 | Noguchi et al. | 34/596 |
| 6,148,647 | A | 11/2000 | Kabeya et al. | 68/140 |
| 6,343,492 | B1 | 2/2002 | Seagar et al. | 68/142 |
| 6,363,756 | B1 | 4/2002 | Seagar et al. | 68/210 |
| 6,460,382 | B1 | 10/2002 | Kim et al. | 68/140 |
| 6,474,114 | B1 | 11/2002 | Ito et al. | 68/140 |
| 6,477,867 | B1 | 11/2002 | Collecutt et al. | 68/12.06 |
| 6,481,035 | B2 | 11/2002 | Seagar et al. | 81/159 |
| 6,510,715 | B1 | 1/2003 | Simsek et al. | 68/12.06 |
| 6,510,716 | B1 | 1/2003 | Kim et al. | 68/24 |
| 6,516,638 | B1 | 2/2003 | Myerscough | 68/23.1 |
| 6,539,753 | B1 | 4/2003 | Ito et al. | 68/3 |
| 6,557,383 | B1 | 5/2003 | Ito et al. | 68/23.2 |
| 6,564,594 | B1 | 5/2003 | Ito et al. | 68/24 |
| 6,578,225 | B2 | 6/2003 | Jönsson | 8/159 |
| 6,578,391 | B2 | 6/2003 | Seagar et al. | 68/142 |
| 6,612,138 | B2 | 9/2003 | Ryu et al. | |
| 6,626,014 | B2 | 9/2003 | Heyder et al. | 68/140 |
| 6,662,682 | B2 | 12/2003 | Stalsberg | |
| 6,681,602 | B2 | 1/2004 | Heyder et al. | |
| 6,782,722 | B2 | 8/2004 | Yokoi et al. | |
| 6,968,632 | B2 | 11/2005 | Guinibert et al. | |

| | | | | |
|---|---|---|---|---|
| 6,981,395 | B2 | 1/2006 | Ryu et al. | 68/17 |
| 7,013,682 | B2 | 3/2006 | Sharrow | |
| 7,065,905 | B2 | 6/2006 | Guinibert et al. | |
| 7,073,356 | B2 | 7/2006 | Nakamura et al. | 68/12.26 |
| 7,117,613 | B2 | 10/2006 | Guinibert et al. | |
| 7,225,562 | B2 | 6/2007 | Guinibert et al. | |
| 7,249,742 | B2 | 7/2007 | Guinibert et al. | |
| 7,257,905 | B2 | 8/2007 | Guinibert et al. | |
| 7,334,799 | B2 | 2/2008 | O'Hara | 277/361 |
| 7,412,783 | B2 | 8/2008 | Guinibert et al. | |
| 7,467,483 | B2 | 12/2008 | Guinibert et al. | |
| 7,520,148 | B2 | 4/2009 | Choi | |
| 7,536,882 | B2 | 5/2009 | Kim et al. | |
| 7,762,007 | B2 | 7/2010 | Guinibert et al. | |
| 7,797,971 | B2 | 9/2010 | Kawabata et al. | |
| 7,841,220 | B2 | 11/2010 | Lim et al. | |
| 2002/0000108 | A1 | 1/2002 | Heyder et al. | |
| 2002/0014095 | A1 | 2/2002 | Seagar et al. | |
| 2002/0042957 | A1 | 4/2002 | Kim et al. | |
| 2002/0166349 | A1 | 11/2002 | Lim et al. | 68/23.7 |
| 2003/0056302 | A1 | 3/2003 | Broker et al. | 8/159 |
| 2003/0061841 | A1 | 4/2003 | Nakamura et al. | |
| 2004/0025544 | A1 | 2/2004 | Kim et al. | 68/3 |
| 2004/0031295 | A1 | 2/2004 | Choi | 68/24 |
| 2004/0035155 | A1 | 2/2004 | Yoon | 68/145 |
| 2004/0123631 | A1 | 7/2004 | Chang | 68/23.1 |
| 2004/0129035 | A1 | 7/2004 | Chang | 68/23 |
| 2004/0163425 | A1 | 8/2004 | Kim et al. | |
| 2004/0163428 | A1 | 8/2004 | Kim et al. | 68/140 |
| 2004/0237603 | A1 | 12/2004 | Kim et al. | 68/15 |
| 2004/0244121 | A1 | 12/2004 | Lim et al. | 8/159 |
| 2004/0244168 | A1 | 12/2004 | Lee | 29/283.5 |
| 2004/0244438 | A1 | 12/2004 | North | |
| 2005/0028564 | A1 | 2/2005 | Lee et al. | 68/24 |
| 2005/0188472 | A1 | 9/2005 | Park et al. | 8/158 |
| 2005/0274159 | A1 | 12/2005 | Jeon et al. | |
| 2006/0010612 | A1 | 1/2006 | Kim et al. | 8/158 |
| 2006/0011429 | A1 | 1/2006 | Park et al. | 188/322.13 |
| 2006/0016228 | A1 | 1/2006 | Chang et al. | 68/23.1 |
| 2006/0254321 | A1 | 11/2006 | Lim et al. | |
| 2007/0125135 | A1 | 6/2007 | Kim et al. | 69/140 |
| 2007/0227200 | A1 | 10/2007 | Kim et al. | 68/140 |

FOREIGN PATENT DOCUMENTS

| | | | |
|---|---|---|---|
| CN | 1293276 | | 5/2001 |
| CN | 1332816 | A | 1/2002 |
| CN | 1511997 | A | 7/2004 |
| CN | 1515732 | A | 7/2004 |
| CN | 1550609 | A | 12/2004 |
| CN | 1614123 | | 5/2005 |
| DE | 1 095 778 | | 12/1960 |
| DE | 1 113 439 | | 9/1961 |
| DE | 1 188 547 | | 3/1965 |
| DE | 19 12 481 | U | 3/1965 |
| DE | 24 01 888 | A1 | 7/1975 |
| DE | 24 54 489 | A1 | 5/1976 |
| DE | 26 06 589 | | 9/1976 |
| DE | 26 33 604 | A1 | 2/1978 |
| DE | 27 32 684 | A1 | 2/1978 |
| DE | 27 46 989 | A1 | 4/1978 |
| DE | 31 09 641 | A1 | 2/1982 |
| DE | 31 34 633 | A1 | 8/1982 |
| DE | 34 37 835 | A1 | 5/1985 |
| DE | 37 13 921 | | 11/1988 |
| DE | 38 11 583 | A1 | 10/1989 |
| DE | 39 07 258 | A1 | 10/1989 |
| DE | 39 34 434 | A1 | 4/1991 |
| DE | 42 39 504 | A1 | 5/1994 |
| DE | 43 10 594 | A1 | 10/1994 |
| DE | 4 426 900 | | 2/1995 |
| DE | 43 30 079 | A1 | 3/1995 |
| DE | 198 06 884 | | 8/1999 |
| DE | 199 61 780 | | 7/2001 |
| EP | 0 124 939 | B1 | 11/1984 |
| EP | 0 132 805 | A1 | 2/1985 |
| EP | 0 212 259 | | 3/1987 |
| EP | 0 272 949 | B1 | 6/1988 |
| EP | 0 371 926 | A1 | 6/1990 |
| EP | 0 405 068 | B1 | 1/1991 |
| EP | 0 465 885 | | 1/1992 |
| EP | 0 716 177 | B1 | 6/1996 |
| EP | 0 750 064 | A1 | 12/1996 |
| EP | 0 869 212 | | 10/1998 |
| EP | 0 943 720 | | 9/1999 |
| EP | 0 969 134 | A1 | 1/2000 |
| EP | 0 725 179 | B1 | 7/2000 |
| EP | 1 055 765 | A1 | 11/2000 |
| EP | 1 079 014 | B1 | 2/2001 |
| EP | 1 094 239 | B1 | 4/2001 |
| EP | 1 201 810 | | 5/2002 |
| EP | 1 386 996 | B1 | 2/2004 |
| EP | 1 433 890 | B1 | 6/2004 |
| EP | 1 433 891 | A2 | 6/2004 |
| EP | 1 455 011 | | 9/2004 |
| EP | 1 505 191 | A1 | 2/2005 |
| EP | 1 548 170 | | 6/2005 |
| EP | 1 605 088 | A2 | 12/2005 |
| EP | 1 619 286 | | 1/2006 |
| EP | 1 688 531 | A1 | 8/2006 |
| FR | 2 230 782 | | 1/1975 |
| FR | 2 478 151 | | 9/1981 |
| FR | 2 511 401 | | 2/1983 |
| FR | 2 610 017 | | 7/1988 |
| GB | 646582 | | 11/1950 |
| GB | 1120431 | | 7/1968 |
| GB | 1 181 797 | | 2/1970 |
| GB | 1 270 950 | | 4/1972 |
| GB | 1 353 283 | | 5/1974 |
| GB | 2 096 649 | A | 10/1982 |
| GB | 2 157 326 | A | 10/1985 |
| GB | 2 189 511 | | 10/1987 |
| GB | 2 202 867 | A | 10/1988 |
| GB | 2 360 296 | | 9/2001 |
| JP | 39-21844 | U | 7/1962 |
| JP | 48-64179 | | 8/1973 |
| JP | 49-135264 | | 11/1974 |
| JP | 52-134264 | | 11/1977 |
| JP | 54-028470 | | 3/1979 |
| JP | 56-116987 | A | 9/1981 |
| JP | 57-43792 | A | 3/1982 |
| JP | 59-211496 | A | 11/1984 |
| JP | 60-190998 | | 9/1985 |
| JP | 63-95587 | U | 6/1988 |
| JP | 01-230390 | | 9/1989 |
| JP | 02-189188 | | 7/1990 |
| JP | 03-141988 | | 6/1991 |
| JP | 03-88479 | U | 9/1991 |
| JP | 04-092697 | A | 3/1992 |
| JP | 04-210091 | | 7/1992 |
| JP | 04-220291 | | 8/1992 |
| JP | 04-236988 | A | 8/1992 |
| JP | 04-240488 | A | 8/1992 |
| JP | 04-325196 | | 11/1992 |
| JP | 04-371194 | A | 12/1992 |
| JP | 05-084388 | A | 4/1993 |
| JP | 05-084389 | | 4/1993 |
| JP | 05-220293 | A | 8/1993 |
| JP | 06-079087 | A | 3/1994 |
| JP | 09-066185 | | 3/1997 |
| JP | 09-182368 | | 7/1997 |
| JP | 09-182370 | A | 7/1997 |
| JP | 9-313780 | | 12/1997 |
| JP | 10-201993 | A | 8/1998 |
| JP | 10-263265 | | 10/1998 |
| JP | 11-076680 | A | 3/1999 |
| JP | 2000-262796 | A | 9/2000 |
| JP | 2000-334194 | A | 12/2000 |
| JP | 2002-153695 | A | 5/2002 |
| JP | 2002-529173 | T | 9/2002 |
| JP | 2002-346281 | A | 12/2002 |
| JP | 2003-079995 | * | 3/2003 |
| JP | 2003-230792 | A | 8/2003 |
| JP | 2004-513721 | | 5/2004 |
| JP | 2004-188204 | | 7/2004 |
| JP | 2004-209255 | | 7/2004 |
| JP | 2005-198698 | | 7/2005 |
| JP | 2006-026408 | | 2/2006 |
| JP | 2006-034755 | | 2/2006 |

| | | | |
|---|---|---|---|
| KR | 10-1999-0066050 | A | 8/1999 |
| KR | 10-1999-0079731 | A | 11/1999 |
| KR | 10-2001-0009545 | A | 2/2001 |
| KR | 2001-0046776 | | 6/2001 |
| KR | 10-2004-0011307 | A | 2/2004 |
| KR | 10-2004-0047223 | A | 6/2004 |
| KR | 10-2004-0058999 | A | 7/2004 |
| KR | 10-2006-0009075 | | 1/2006 |
| KR | 10-2006-0028804 | | 4/2006 |
| SU | 1181112 | A | 9/1986 |
| SU | 1615258 | | 12/1990 |
| SU | 1663074 | A1 | 7/1991 |
| SU | 1 703 740 | | 1/1992 |
| WO | WO 98/29595 | A2 | 7/1998 |
| WO | WO 99/35320 | | 7/1999 |
| WO | WO 03/097918 | | 11/2003 |
| WO | WO 2005/071155 | | 8/2005 |

OTHER PUBLICATIONS

U.S. Final Office Action dated Aug. 14, 2006 issued in U.S. Appl. No. 10/461,451.
U.S. Final Office Action dated Dec. 13, 2006 issued in U.S. Appl. No. 10/461,451.
U.S. Office Action dated Jan. 5, 2007 issued in U.S. Appl. No. 11/475,885.
U.S. Office Action dated Apr. 27, 2007 issued in U.S. Appl. No. 10/461,451.
U.S. Office Action dated Jun. 8, 2007 issued in U.S. Appl. No. 11/470,704.
U.S. Office Action dated Nov. 30, 2007 issued in U.S. Appl. No. 11/470,704.
U.S. Final Office Action dated Jul. 17, 2007 issued in U.S. Appl. No. 11/475,885.
U.S. Office Action dated Nov. 19, 2007 issued in U.S. Appl. No. 10/461,451.
U.S. Office Action dated Apr. 1, 2008 issued in U.S. Appl. No. 11/475,885.
U.S. Final Office Action dated May 15, 2008 issued in U.S. Appl. No. 11/470,704.
U.S. Final Office Action dated Jun. 16, 2008 issued in U.S. Appl. No. 10/461,451.
U.S. Office Action dated Sep. 5, 2008 issued in U.S. Appl. No. 11/165,332.
U.S. Office Action dated Sep. 11, 2008 issued in U.S. Appl. No. 11/470,704.
U.S. Final Office Action dated Feb. 25, 2009 issued in U.S. Appl. No. 11/165,332.
U.S. Office Action dated Feb. 25, 2009 issued in U.S. Appl. No. 12/198,269.
Japanese Office Action dated Mar. 2, 2009 issued in Application No. 2004-000478.
Japanese Office Action dated Dec. 18, 2009 issued in Application No. 2004-000478.
U.S. Office Action dated Sep. 21, 2009 issued in U.S. Appl. No. 12/267,457.
U.S. Final Office Action dated Oct. 14, 2009 issued in U.S. Appl. No. 12/198,269.
U.S. Office Action dated Oct. 15, 2009 issued in U.S. Appl. No. 11/529,759.
U.S. Office Action dated Oct. 28, 2009 issued in U.S. Appl. No. 12/230,031.
Chinese Office Action issued in CN Application No. 200710089087.4 dated Jan. 8, 2010.
U.S. Office Action dated Feb. 2, 2010 issued in U.S. Appl. No. 12/198,269.
European Search Report dated Feb. 3, 2010 issued in Application No. 09178918.0.
U.S. Final Office Action dated Mar. 5, 2010 issued in U.S. Appl. No. 12/267,457.
Chinese Office Action dated Mar. 8, 2010 issued in Application No. 200610142200.6.
U.S. Final Office Action dated Mar. 19, 2010 issued in U.S. Appl. No. 11/529,759.
Notice of Opposition dated May 7, 2010 filed in the European Patent Office for European Patent Application No. 05013603.5 (Publication No. EP 1 619 286 B1).
U.S. Final Office Action dated May 14, 2010 issued in U.S. Appl. No. 12/230,031.
Japanese Office Action issued in JP Application No. 2005-204374 dated Jul. 28, 2010.
Japanese Office Action issued in JP Application No. 2006-235745 dated Aug. 3, 2010.
U.S. Office Action dated Aug. 13, 2010 issued in U.S. Appl. No. 12/639,872.
Notice of Opposition and Opposition Brief filed in EP Application No. 03013411.8 dated Sep. 29, 2010 (Publication No. EP 1 433 890 B1) (full German text and English translation).
U.S. Office Action issued in U.S. Application No. 12/797,758 dated Oct. 28, 2010.
European Search Report issued in EP Application No. 10012467 dated Nov. 25, 2010.
U.S. Office Action issued in U.S. Application No. 12/639,859 dated Dec. 9, 2010.
U.S. Office Action issued in U.S. Application No. 12/940,138 dated Dec. 16, 2010.
U.S. Office Action issued in U.S. Application No. 12/639,894 dated Dec. 23, 2010.
U.S. Office Action issued in U.S. Appl. No. 12/985,389 dated Mar. 16, 2011.
Final U.S. Office Action issued in U.S. Appl. No. 12/797,758 dated Mar. 17, 2011.
European Search Report issued in EP Application No. 10012465 dated Mar. 24, 2011.
European Search Report issued in EP Application No. 10012469 dated Apr. 8, 2011.
European Search Report issued in EP Application No. 10012470 dated Apr. 8, 2011.
U.S. Office Action issued in U.S. Appl. No. 12/940,096 dated Apr. 18, 2011.
Final U.S. Office Action issued in U.S. Appl. No. 12/639,859 dated Apr. 27, 2011.
European Search Report issued in EP Application No. 10012468 dated May 4, 2011.
Final U.S. Office Action issued in U.S. Appl. No. 12/940,138 dated May 20, 2011.
U.S. Final Office Action issued in U.S. Application U.S. Appl. No. 12/639,894 dated Aug. 3, 2011.
U.S. Final Office Action issued in U.S. Application U.S. Appl. No. 12/985,389 dated Aug. 8, 2011.
U.S. Final Office Action issued in U.S. Application U.S. Appl. No. 12/940,096 dated Sep. 8, 2011.
Summons to Attend Oral Proceedings issued in EP Application No. 03013411.8 dated Jul. 14, 2011.
Office Action issued in U.S. Appl. No. 13/116,059 dated Nov. 28, 2011.
Office Action issued in U.S. Appl. No. 13/116,096 dated Nov. 29, 2011.
Office Action issued in U.S. Appl. No. 13/116,114 dated Nov. 29, 2011.
Office Action issued in U.S. Appl. No. 13/116,077 dated Nov. 30, 2011.
Office Action issued in U.S. Appl. No. 13/116,089 dated Nov. 30, 2011.
Office Action issued in U.S. Appl. No. 13/116,159 dated Nov. 30, 2011.
Office Action issued in U.S. Appl. No. 13/116,147 dated Nov. 30, 2011.
Office Action issued in U.S. Appl. No. 13/116,105 dated Dec. 1, 2011.
European Office Action issued in EP Application No. 10 012 465.0-2314 dated Dec. 7, 2011.
Office Action issued in U.S. Appl. No. 13/241,366 dated Jan. 31, 2012.
Notice of Allowance issued in U.S. Appl. No. 13/239,439 dated Feb. 9, 2012.

Notice of Allowance issued in U.S. Appl. No. 13/239,448 dated Feb. 10, 2012.
Office Action issued in U.S. Appl. No. 13/241,366 dated Feb. 10, 2012.
Office Action issued in U.S. Appl. No. 13/241,348 dated Feb. 23, 2012.
Office Action issued in U.S. Appl. No. 13/239,424 dated Feb. 29, 2012.
Office Action issued in U.S. Appl. No. 13/241,411 dated Mar. 6, 2012.
Office Action issued in U.S. Appl. No. 13/239,427 dated Mar. 21, 2012.
Office Action issued in U.S. Appl. No. 13/241,337 dated Mar. 22, 2012.
Office Action issued in U.S. Appl. No. 13/116,089 dated Apr. 13, 2012.
Office Action issued in U.S. Appl. No. 13/116,077 dated Apr. 16, 2012.
Office Action issued in U.S. Appl. No. 13/116,096 dated Apr. 16, 2012.
Office Action issued in U.S. Appl. No. 13/116,114 dated Apr. 18, 2012.
Office Action issued in U.S. Appl. No. 13/116,159 dated Apr. 18, 2012.
Office Action issued in U.S. Appl. No. 13/239,430 dated May 4, 2012.
Office Action issued in U.S. Appl. No. 13/239,422 dated May 9, 2012.
Final Office Action issued in U.S. Appl. No. 13/241,348 dated Jun. 25, 2012.
Final Office Action issued in U.S. Appl. No. 13/241,366 dated Jun. 26, 2012.
Final Office Action issued in U.S. Appl. No. 13/241,396 dated Jun. 27, 2012.
Supplemental Notice of Allowability issued in U.S. Appl. No. 13/239,424 dated Jul. 10, 2012.
Non-Final Office Action issued in U.S. Appl. No. 13/239,410 dated Jul. 19, 2012.
Final Office Action issued in U.S. Appl. No. 13/241,337 dated Sep. 18, 2012.
Non-Final Office Action issued in U.S Appl. No. 13/116,096 dated Sep. 21, 2012.

* cited by examiner

DRUM-TYPE WASHING MACHINE

The present application is a 37 C.F.R. §1.53(b) continuation of U.S. patent application Ser. No. 12/985,389 filed on Jan. 6, 2011, which is a 37 C.F.R. §1.53(b) continuation of U.S. patent application Ser. No. 12/639,872 filed on Dec. 16, 2009, now U.S. Pat. No. 7,930,910 B2, which is a 37 C.F.R. §1.53(b) continuation of U.S. patent application Ser. No. 12/267,457 filed Nov. 7, 2008, currently pending, which is a 37 C.F.R. §1.53(b) continuation of U.S. patent application Ser. No. 10/461,451 filed Jun. 16, 2003, now U.S. Pat. No. 7,533,548 B2, which claims priority to Korean Patent Application No. 85521/2002, filed Dec. 27, 2002, the entire contents of which are hereby incorporated by reference herein.

BACKGROUND OF THE INVENTION

1. Field of the Invention

The present invention relates to a drum type washing machine, and more particularly, to a drum type washing machine which can maximize a capacity of a drum without changing an entire size of a washing machine.

2. Description of the Related Art

FIG. 1 is a side sectional view showing a drum type washing machine in accordance with the conventional art, FIG. 2 is a front sectional view showing the drum type washing machine in accordance with the conventional art.

The conventional drum type washing machine comprises: a cabinet 102 for forming an appearance; a tub 104 arranged in the cabinet 102 for storing washing water; a drum 106 rotatably arranged in the tub 104 for washing and dehydrating laundry; and a driving motor 110 positioned at a rear side of the tub 104 and connected to the drum 106 by a driving shaft 108 thus for rotating the drum 106.

An inlet 112 for inputting or outputting the laundry is formed at the front side of the cabinet 102, and a door 114 for opening and closing the inlet 112 is formed at the front side of the inlet 112. The tub 104 of a cylindrical shape is provided with an opening 116 at the front side thereof thus to be connected to the inlet 112 of the cabinet 102, and a balance weight 118 for maintaining a balance of the tub 104 and reducing vibration are respectively formed at both sides of the tub 104.

Herein, a diameter of the tub 104 is installed to be less than a width of the cabinet 102 by approximately 30-40 mm with consideration of a maximum vibration amount thereof so as to prevent from being contacted to the cabinet 102 at the time of the dehydration.

The drum 106 is a cylindrical shape of which one side is opened so that the laundry can be inputted, and has a diameter installed to be less than that of the tub 104 by approximately 15-20 mm in order to prevent interference with the tub 104 since the drum is rotated in the tub 104.

A plurality of supporting springs 120 are installed between the upper portion of the tub 104 and the upper inner wall of the cabinet 102, and a plurality of dampers 122 are installed between the lower portion of the tub 104 and the lower inner wall of the cabinet 102, thereby supporting the tub 104 with buffering.

A gasket 124 is formed between the inlet 112 of the cabinet 102 and the opening 116 of the tub 104 so as to prevent washing water stored in the tub 104 from being leaked to a space between the tub 104 and the cabinet 102. Also, a supporting plate 126 for mounting the driving motor 110 is installed at the rear side of the tub 104.

The driving motor 110 is fixed to a rear surface of the supporting plate 126, and the driving shaft 108 of the driving motor 110 is fixed to a lower surface of the drum 106, thereby generating a driving force by which the drum 106 is rotated.

In the conventional drum type washing machine, the diameter of the tub 104 is installed to be less than the width of the cabinet 102 with consideration of the maximum vibration amount so as to prevent from being contacted to the cabinet 102, and the diameter of drum 106 is also installed to be less than that of the tub 104 in order to prevent interference with the tub 104 since the drum is rotated in the tub 104. According to this, so as to increase the diameter of the drum 106 which determines a washing capacity, a size of the cabinet 102 has to be increased.

Also, since the gasket 124 for preventing washing water from being leaked is installed between the inlet 112 of the cabinet 102 and the opening 116 of the tub 104, a length of the drum 106 is decreased as the installed length of the gasket 124. According to this, it was difficult to increase the capacity of the drum 106.

SUMMARY OF THE INVENTION

Therefore, an object of the present invention is to provide a drum type washing machine which can increase a washing capacity without changing an entire size thereof, in which a cabinet and a tub is formed integrally and thus a diameter of a drum can be increased without increasing a size of the cabinet.

Another object of the present invention is to provide a drum type washing machine which can increase a washing capacity by increasing a length of a drum without increasing a length of a cabinet, in which the cabinet and a tub are formed integrally and thus a location of a gasket is changed.

To achieve these and other advantages and in accordance with the purpose of the present invention, as embodied and broadly described herein, there is provided a drum type washing machine comprising: a cabinet for forming an appearance; a tub fixed to an inner side of the cabinet and for storing washing water; a drum rotatably arranged in the tub for washing and dehydrating laundry; and a driving motor positioned at the rear side of the drum for generating a driving force by which the drum is rotated.

The tub is a cylindrical shape, and a front surface thereof is fixed to a front inner wall of the cabinet.

Both sides of the tub are fixed to both sides inner wall of the cabinet.

A supporting plate for mounting the driving motor is located at the rear side of the tub, and a gasket hermetically connects the supporting plate and the rear side of the tub, in which the gasket is formed as a bellows and has one side fixed to the rear side of the tub and another side fixed to an outer circumference surface of the supporting plate.

A supporting unit for supporting an assembly composed of the drum, the driving motor, and the supporting plate with buffering is installed between the supporting plate and the cabinet.

The supporting unit comprises: a plurality of upper supporting rods connected to an upper side of the supporting plate towards an orthogonal direction and having a predetermined length; buffering springs connected between the upper supporting rods and an upper inner wall of the cabinet for buffering; a plurality of lower supporting rods connected to a lower side of the supporting plate towards an orthogonal direction and having a predetermined length; and dampers connected between the lower supporting rods and a lower inner wall of the cabinet for absorbing vibration.

The drum is provided with a liquid balancer at a circumference of an inlet thereof for maintaining a balance when the drum is rotated.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
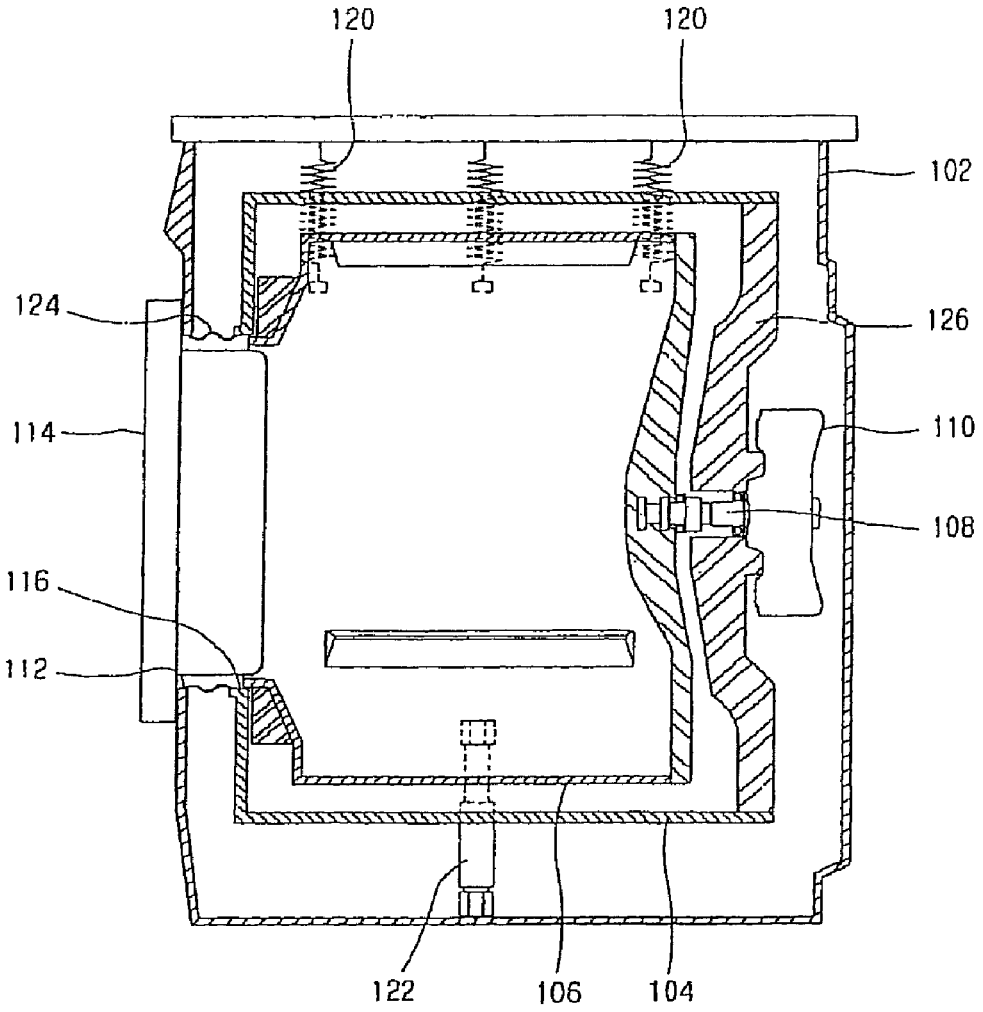
FIG. 1 CONVENTIONAL ART
FIG. 1 is a side sectional view showing a drum type washing machine in accordance with the conventional art.
Figure 2:
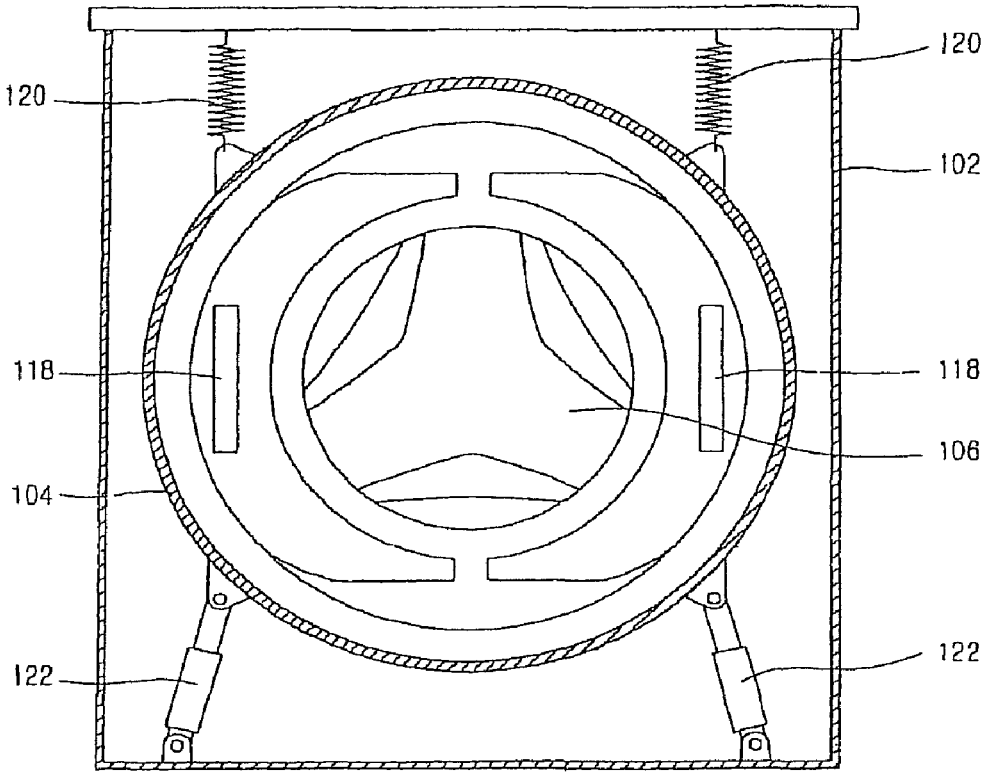
FIG. 2 CONVENTIONAL ART
FIG. 2 is a front sectional view showing the drum type washing machine in accordance with the conventional art.
Figure 3:
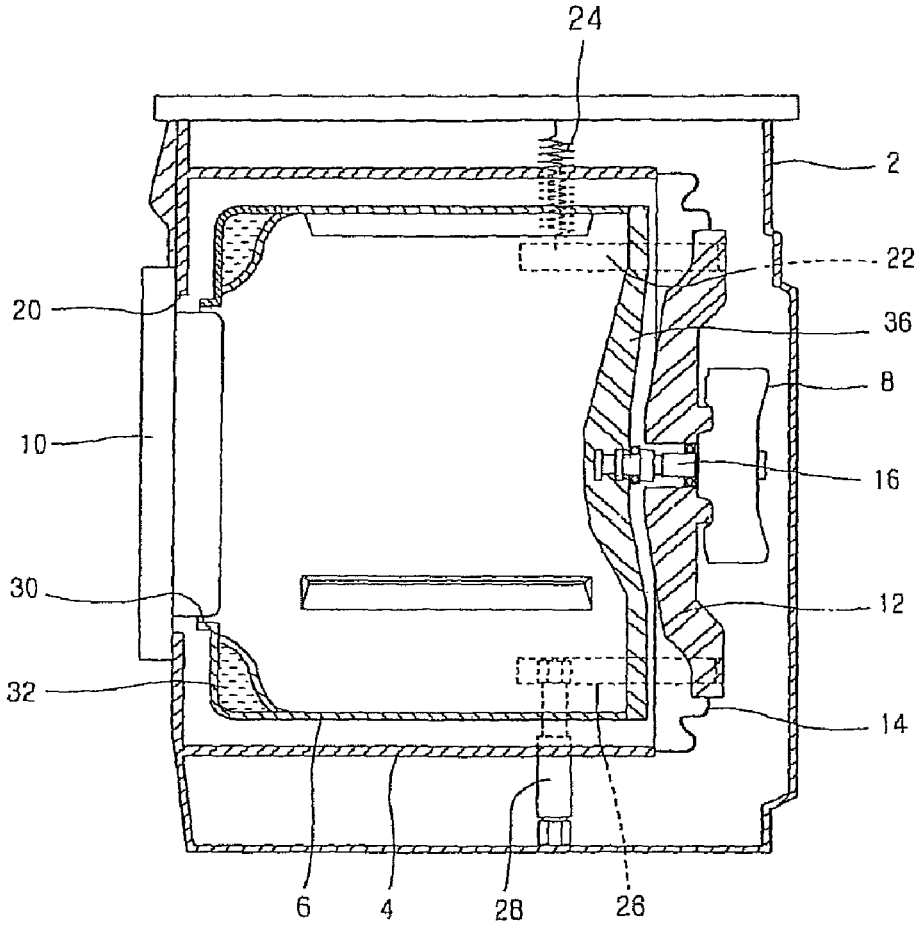
FIG. 3 is a side sectional view showing a drum type washing machine according to one embodiment of the present invention.
Figure 4:
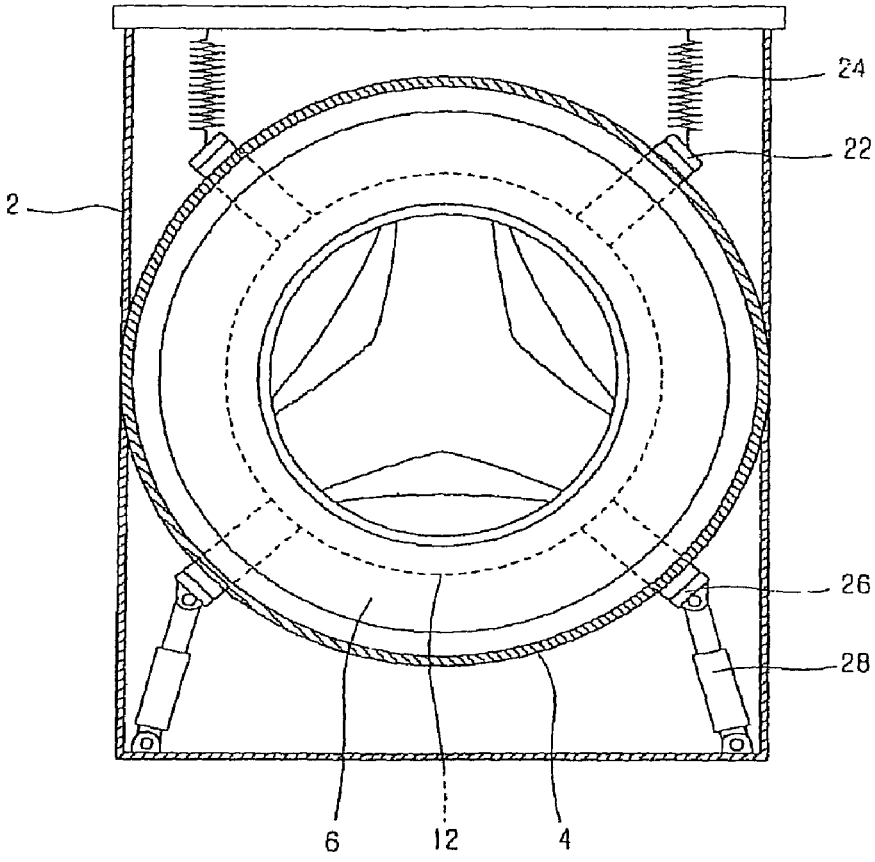
FIG. 4 is a front sectional view showing the drum type washing machine according to one embodiment of the present invention.
Figure 5:
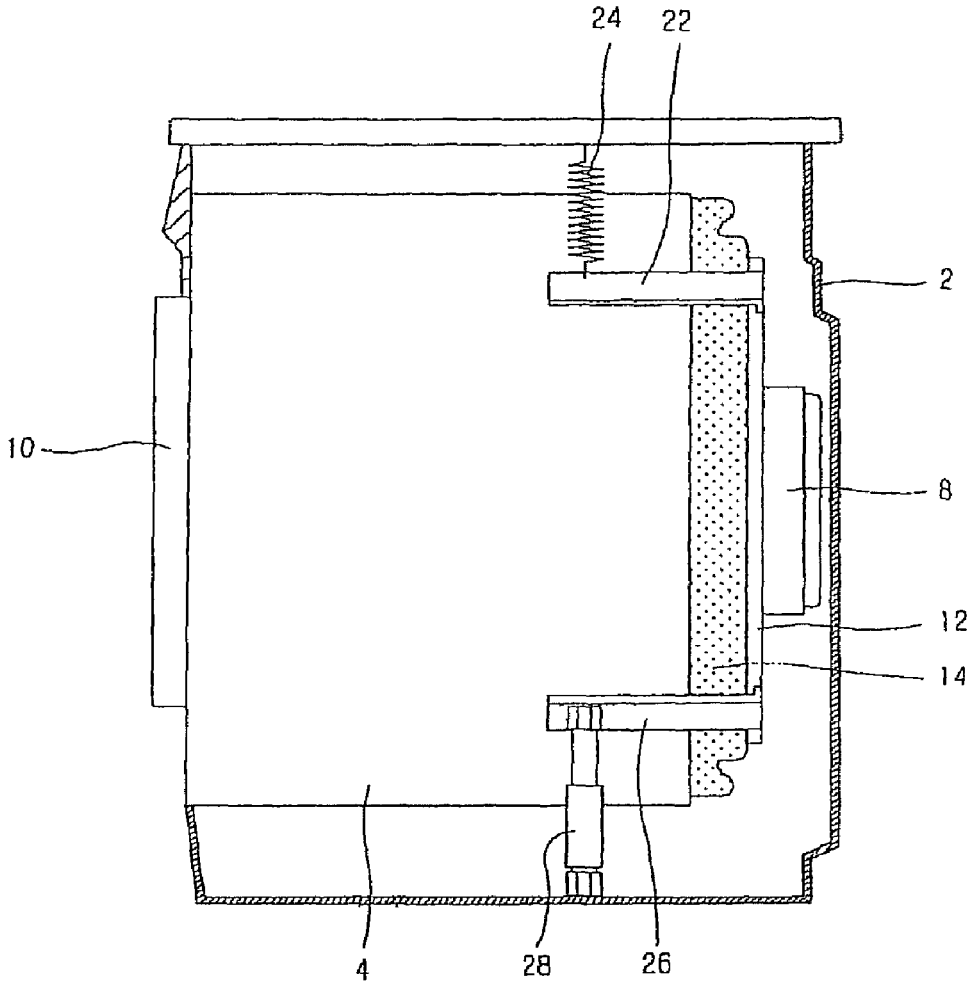
FIG. 5 is a lateral view showing a state that a casing of the drum type washing machine according to one embodiment of the present invention is cut.

FIG. 3 is a side sectional view showing a drum type washing machine according to one embodiment of the present invention, and FIG. 4 is a front sectional view showing the drum type washing machine according to one embodiment of the present invention.

The drum type washing machine according to one embodiment of the present invention comprises: a cabinet 2 for forming an appearance of a washing machine; a tub 4 formed integrally with the cabinet 2 and for storing washing water; a drum 6 rotatably arranged in the tub 4 for washing and dehydrating laundry; and a driving motor 8 positioned at the rear side of the drum 6 for generating a driving force by which the drum 6 is rotated.

The cabinet 2 is rectangular parallelepiped, and an inlet 20 for inputting and outputting laundry is formed at the front side of the cabinet 2 and a door 10 for opening and closing the inlet 20 is formed at the inlet 20.

The tub 4 is formed as a cylinder shape having a predetermined diameter in the cabinet 2, and the front side of the tub 4 is fixed to the front inner wall of the cabinet 2 or integrally formed at the front inner wall of the cabinet 2. Both sides of the tub 4 are contacted to both sides inner wall of the cabinet 2 or integrally formed with both sides inner wall of the cabinet 2 thus to be prolonged.

Herein, since both sides of the tub 4 are contacted to both sides inner wall of the cabinet 2, a diameter of the tub 4 can be increased.

Also, the supporting plate 12 is positioned at the rear side of the tub 4 and the gasket 14 is installed between the supporting plate 12 and the rear side of the tub 4, thereby preventing washing water filled in the tub 4 from being leaked.

The gasket 14 is formed as a bellows of a cylinder shape and has one side fixed to the rear side of the tub 4 and another side fixed to an outer circumference surface of the supporting plate 12.

The supporting plate 12 is formed as a disc shape, the driving motor 8 is fixed to the rear surface thereof, and a rotation shaft 16 for transmitting a rotation force of the driving motor 8 to the drum 6 is rotatably supported by the supporting plate 12. Also, a supporting unit for supporting the drum 6 with buffering is installed between the supporting plate 12 and the inner wall of the cabinet 2.

The supporting unit comprises: a plurality of upper supporting rods 22 connected to an upper side of the supporting plate 12 and having a predetermined length; buffering springs 24 connected between the upper supporting rods 22 and an upper inner wall of the cabinet 2 for buffering; a plurality of lower supporting rods 26 connected to a lower side of the supporting plate 12 and having a predetermined length; and dampers 28 connected between the lower supporting rods 26 and a lower inner wall of the cabinet 2 for absorbing vibration.

Herein, the buffering springs 24 and the dampers 28 are installed at a center of gravity of an assembly composed of the drum 6, the supporting plate 12, and the driving motor 8. That is, the upper and lower supporting rods 22 and 26 are prolonged from the supporting plate 12 to the center of gravity of the assembly, the buffering springs 24 are connected between an end portion of the upper supporting rod 22 and the upper inner wall of the cabinet 2, and the dampers 28 are connected between an end portion of the lower supporting rod 26 and the lower inner wall of the cabinet 2, thereby supporting the drum 6 at the center of gravity.

A diameter of the drum 6 is installed in a range that the drum 6 is not contacted to the tub 4 even when the drum 6 generates maximum vibration in order to prevent interference with the tub 4 at the time of being rotated in the tub 4.

Operations of the drum type washing machine according to the present invention are as follows.

If the laundry is inputted into the drum 6 and a power switch is turned on, washing water is introduced into the tub 6. At this time, the front side of the tub 6 is fixed to the cabinet 2 and the gasket 14 is connected between the rear side of the tub 6 and the supporting plate 12, thereby preventing the washing water introduced into the tub 6 from being leaked outwardly.

If the introduction of the washing water is completed, the driving motor 8 mounted at the rear side of the supporting plate 12 is driven, and the drum 6 connected with the driving motor 8 by the rotation shaft 16 is rotated, thereby performing washing and dehydration operations. At this time, the assembly composed of the drum 6, the driving motor, and the supporting plate 12 is supported by the buffering springs 24 and the dampers 28 mounted between the supporting plate 12 and the inner wall of the cabinet 20.

Figure 6:
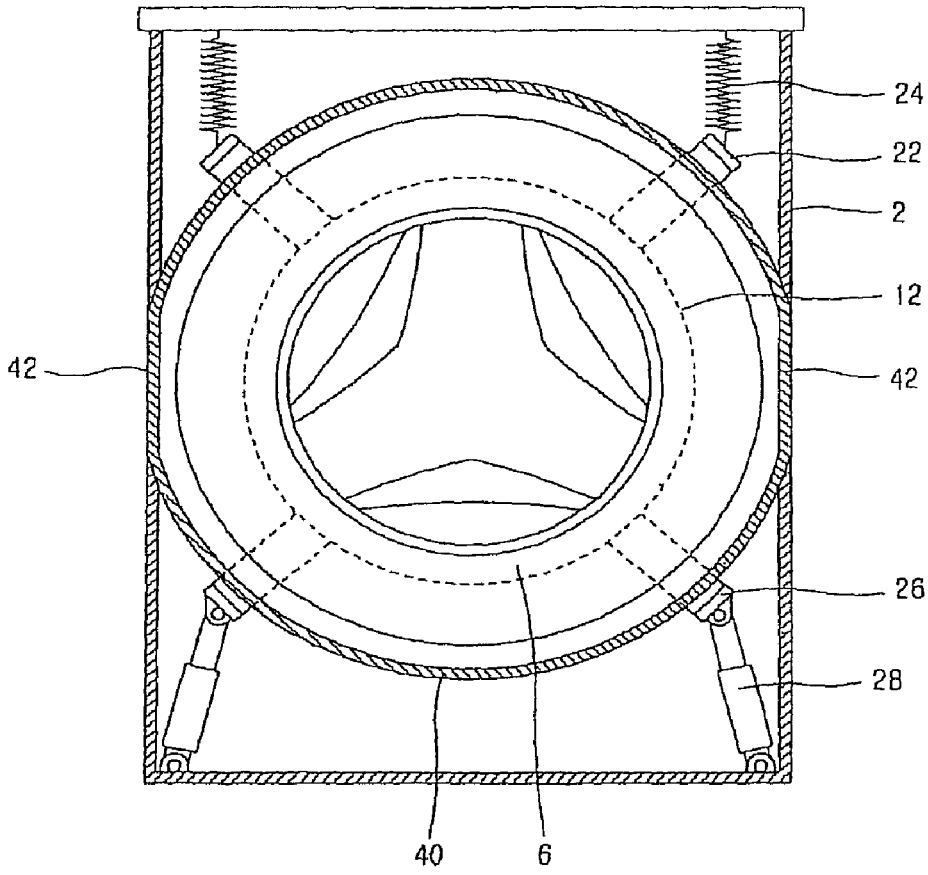
FIG. 6 is a front sectional view of a drum type washing machine according to a second embodiment of the present invention.

FIG. 6 is a front sectional view of a drum type washing machine according to a second embodiment of the present invention.

The drum type washing machine according to the second embodiment of the present invention has the same construction and operation as that of the first to embodiment except a shape of the tub.

That is, the tub 40 according to the second embodiment has a straight line portion 42 with a predetermined length at both sides thereof. The straight line portion 42 is fixed to the inner wall of both sides of the cabinet 2, or integrally formed at the wall surface of both sides of the cabinet 2.

Like this, since the tub 40 according to the second embodiment has both sides fixed to the cabinet 2 as a straight line form, the diameter of the tub 40 can be increased. Accordingly, the diameter of the drum 6 arranged in the tub 40 can be more increased.

Figure 7:
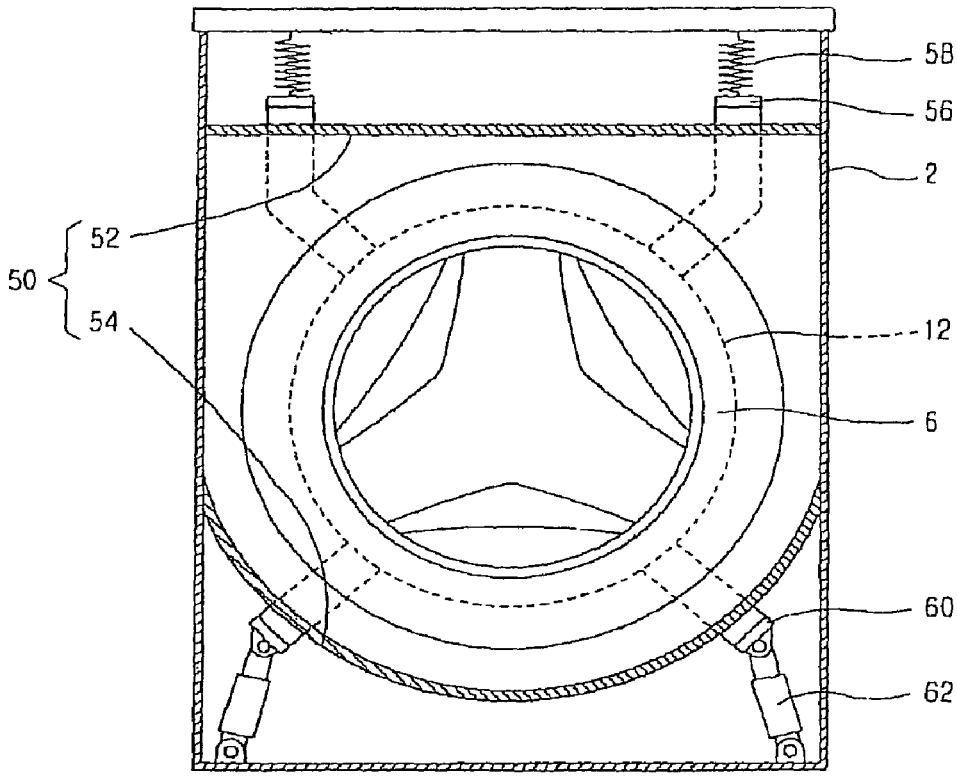
FIG. 7 is a front sectional view showing a drum type washing machine according to a third embodiment of the present invention.
Figure 8:
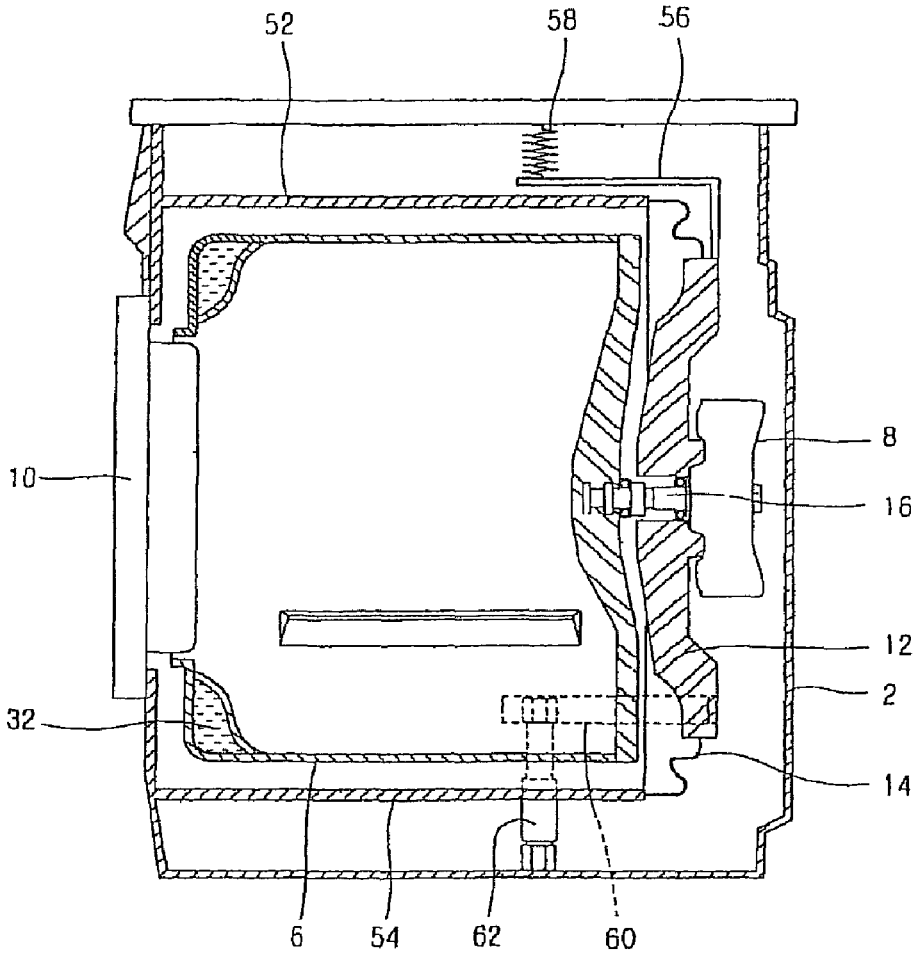
FIG. 8 is a longitudinal sectional view of the drum type washing machine according to the third embodiment of the present invention.
Figure 9:
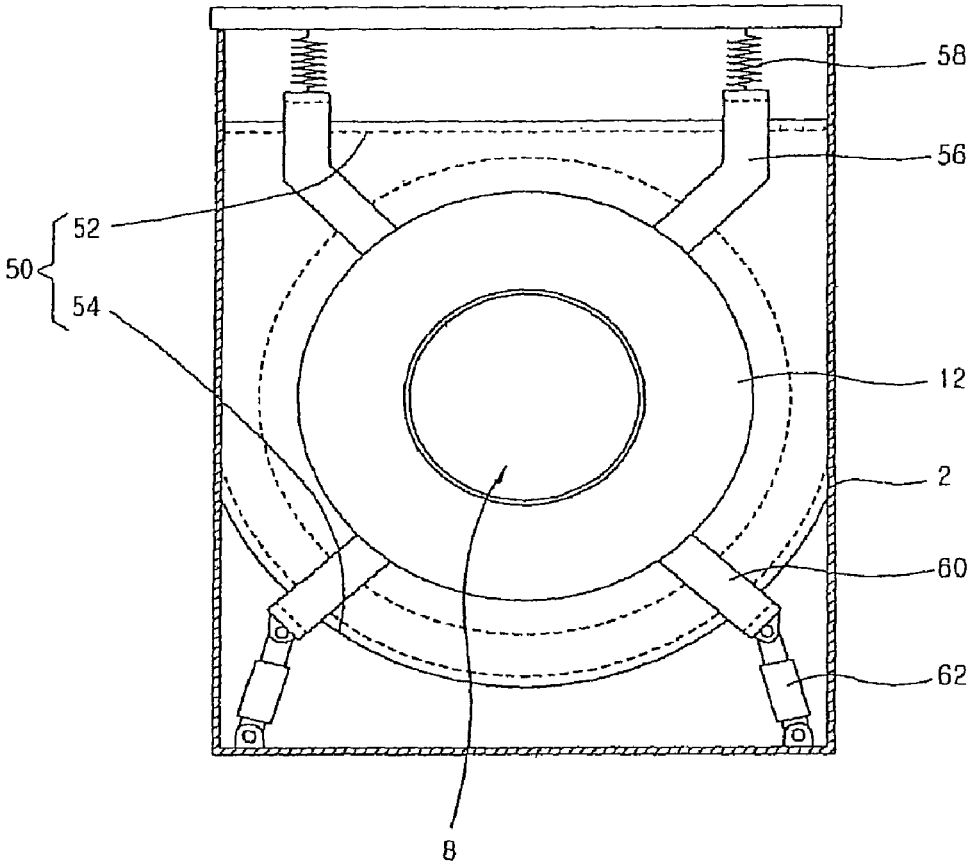
FIG. 9 is a rear sectional view showing the drum type washing machine according to the third embodiment of the present invention.

FIG. 7 is a front sectional view showing a drum type washing machine according to a third embodiment of the present invention, FIG. 8 is a longitudinal sectional view of the drum type washing machine according to the third embodiment of the present invention, and FIG. 9 is a rear sectional view showing the drum type washing machine according to the third embodiment of the present invention.

The drum type washing machine according to the third embodiment of the present invention comprises: a cabinet 2 for forming an appearance of a washing machine; a tub 50 formed integrally with the cabinet 2 and for storing washing water; a drum 6 rotatably arranged in the tub 50 for washing and dehydrating laundry; and a supporting unit positioned at the rear side of the tub 50 and arranged between the supporting plate 12 to which the driving motor 8 is fixed and the cabinet 2 for supporting the drum 6 with buffering.

The tub 50 is composed of a first partition wall 52 fixed to the upper front inner wall and both sides inner wall of the cabinet 2; and a second partition wall 54 integrally fixed to the lower front inner wall and both sides inner wall of the cabinet 2.

The first partition wall 52 of a flat plate shape is formed at the upper side of the cabinet 2 in a state that the front side and both sides are integrally formed at the inner wall of the cabinet 2 or fixed thereto. Also, the second partition wall 54 of a semi-circle shape is formed at the lower side of the cabinet 2 in a state that the front side and both sides are integrally formed at the inner wall of the cabinet 2 or fixed thereto.

The supporting unit comprises: a plurality of upper supporting rods 56 connected to the upper side of the supporting plate 12 and having a predetermined length; buffering springs 58 connected between the upper supporting rods 56 and the upper inner wall of the cabinet 2 for buffering; a plurality of lower supporting rods 60 connected to the lower side of the supporting plate 12 and having a predetermined length; and dampers 62 connected between the lower supporting rods 60 and the lower inner wall of the cabinet 2 for absorbing vibration.

Herein, the upper supporting rods 56 are bent to be connected to the upper side of the supporting plate 12 and positioned at the upper side of the first partition wall 52, and the buffering springs 58 are connected to the end portion of the upper supporting rods 56. Also, the lower supporting rods 60 are bent to be connected to the lower side of the supporting plate 12 and positioned at the lower side of the second partition wall 54, and the dampers 62 are connected to the end portion of the lower supporting rods 56.

In the drum type washing machine according to the present invention, a size of the drum can be maximized by fixing the tub in the cabinet, thereby increasing washing capacity of the drum without increasing a size of the cabinet.

Also, since the front surface of the tub is integrally formed at the inner wall of the cabinet and the gasket is installed between the rear surface of the tub and the supporting plate, a length of the drum can be increased and thus the washing capacity of the drum can be increased.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A drum type washing machine, comprising:
- a cabinet;
- a tub configured to hold washing fluid therein;
- a drum rotatably arranged in the tub;
- a shaft connected to the drum;
- a supporting plate positioned at an open axial end of the tub, wherein the supporting plate rotatably supports the shaft;
- a suspension system that reduces vibration of the drum; and
- a substantially annular gasket connected between the axial end of the tub and the supporting plate such that the gasket and the supporting plate form an axial end wall of the tub, the gasket comprising:
  - a tub connecting portion that is connected to the tub;
  - a supporting plate connecting portion that is positioned radially inward from the tub connecting portion and is connected to the supporting plate; and
  - a flexible portion that extends radially between the tub connecting portion and the supporting plate connecting portion.

2. The drum type washing machine of claim 1, wherein a distance between an outer surface of the tub and a corresponding inner surface of the cabinet is less than a distance between an inner surface of the tub and a corresponding outer surface of the drum.

3. The drum type washing machine of claim 1, wherein the supporting plate is positioned between the motor and the drum, and the motor, the supporting plate and the drum are concentrically arranged, and wherein an outer diameter of the supporting plate is greater than an outer diameter of the motor such that the supporting plate extends radially beyond the motor.

4. The drum type washing machine of claim 1, wherein the suspension system comprises:
- a plurality of supporting rods coupled to the supporting plate and extending outward therefrom; and
- a corresponding plurality of dampers respectively connected between the plurality of supporting rods and the cabinet.

5. The drum type washing machine of claim 1, wherein the suspension system comprises a plurality of supporting rods which extend from the supporting plate in a rotation axis direction of the drum.

6. The drum type washing machine of claim 1, wherein the suspension system comprises a plurality of supporting rods which extend from the supporting plate to a corresponding point aligned with a center of gravity of an assembly comprised of the drum, the supporting plate and the motor.

7. The drum type washing machine of claim 1, wherein the suspension system comprises a plurality of supporting rods which are coupled to a lower portion of the supporting plate, below an axis of rotation of the drum.

8. The drum type washing machine of claim 7, wherein the plurality of supporting rods are distributed on two opposite sides of the axis of rotation of the drum, and below the axis of rotation of the drum.

9. The drum type washing machine of claim 1, wherein the tub is fixed directly to the cabinet or formed integrally with the cabinet, and the suspension device supports the drum within the tub, separately from the tub.

10. The drum type washing machine of claim 1, wherein the motor is coaxially arranged on the shaft and the supporting plate extends radially beyond the motor.

11. A drum type washing machine, comprising:

a case;

a tub received in the case, wherein a distance between a top or a bottom of the tub and a corresponding top or bottom of the case is greater than a distance between a side surface of the tub and a corresponding side wall of the case;

a drum rotatably arranged in the tub;

a shaft connected to the drum;

a motor that rotates the shaft;

a supporting plate positioned at an open axial end of the tub, wherein the supporting plate rotatably supports the shaft;

a suspension system to reduce vibration of the drum; and a substantially annular gasket connected between an axial end of the tub and the supporting plate such that the gasket and the supporting plate form an axial end wall of the tub, the gasket comprising:

a tub connecting portion that is connected to the tub;

a supporting plate connecting portion that is positioned radially inward from the tub connecting portion and is connected to the supporting plate; and a flexible portion that extends radially between the tub connecting portion and the supporting plate connecting portion.

12. A drum type washing machine, comprising:

a case;

a tub received in the case;

a drum rotatably arranged in the tub, wherein a distance between an outer surface of the tub and a corresponding inner side wall of the case is less than a distance between an inner surface of the tub and a corresponding outer surface of the drum;

a shaft connected to the drum;

a motor that rotates the shaft;

a supporting plate positioned at an open axial end of the tub, wherein the supporting plate rotatably supports the shaft;

a suspension system to reduce vibration of the drum; and a substantially annular gasket connected between the open axial end of the tub and the supporting plate such that the gasket and the supporting plate form an axial end wall of the tub, the gasket comprising:

a tub connecting portion that is connected to the tub;

a supporting plate connecting portion that is positioned radially inward from the tub connecting portion and is connected to the supporting plate; and a flexible portion that extends radially between the tub connecting portion and the supporting plate connecting portion.

* * * * *